US006117054A

United States Patent [19]

Soltanpour

[11] Patent Number: 6,117,054

[45] Date of Patent: Sep. 12, 2000

[54] BALL THERAPY DEVICE

[76] Inventor: Nahid Soltanpour, 3081 Moon Lake Dr., West Bloomfield, Mich. 48323

[21] Appl. No.: 09/301,736

[22] Filed: Apr. 29, 1999

[51] Int. Cl.[7] ..... A63B 69/34

[52] U.S. Cl. ..... 482/83; 482/87; 482/148; 482/35; 482/38

[58] Field of Search ..... 482/148, 35, 38, 482/83, 87; 472/118, 31, 125; 217/91; 473/479; 446/450, 227; 297/281; 248/163.2

[56] References Cited

U.S. PATENT DOCUMENTS

| | | | |
|---|---|---|---|
| 1,410,149 | 3/1922 | Stenvig | 482/38 |
| 1,744,594 | 1/1930 | Trzesniewski | 272/41 |
| 2,977,118 | 3/1961 | Farkas | 272/60 |
| 4,084,812 | 4/1978 | Melrose et al. | 272/85 |
| 5,163,828 | 11/1992 | Coddington, Jr. | 472/118 |
| 5,250,002 | 10/1993 | Kinberg | 446/220 |

*Primary Examiner*—Michael A. Brown
*Assistant Examiner*—Lori Baker

[57] ABSTRACT

A ball therapy device for providing a means of exercise for improving strength, range of motion, and coordination. The ball therapy device includes a generally U-shaped frame with a first and a second leg and a cross member extending between upper ends of the legs. Third and fourth legs are pivotally coupled to the upper ends of the first and second legs. A pair of spacing arms are provided. One of the spacing arms is selectively slidably positionable along the first leg and the associated third leg. The other of the spacing arms is selectively slidably positionable along the second leg and the associated fourth leg. A support arm extends between the spacing arms. A ball sleeve rotatably extends around the support arm. The ball sleeve has a cord extending therefrom. A tether ball is coupled to the cord.

6 Claims, 2 Drawing Sheets

BALL THERAPY DEVICE

BACKGROUND OF THE INVENTION

1. Field of the Invention

The present invention relates to therapy devices and more particularly pertains to a new ball therapy device for providing a means of exercise for improving strength, range of motion, and coordination.

2. Description of the Prior Art

The use of therapy devices is known in the prior art. More specifically, therapy devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,716,235; 4,093,225; 4,049,266; 5,393,050; 4,966,367; and 328,935.

While these devices fulfill their respective, particular objectives and requirements, the aforementioned patents do not disclose a new ball therapy device. The inventive device includes a generally U-shaped frame with first and second legs and a cross member extending between upper ends of the legs. A pair of third legs are coupled to the upper ends of the first legs. A pair of spacing arms are provided. One of the spacing arm is slidably coupled to the first leg and the associated third leg. The other of the spacing arms is slidably coupled to the second leg and the associated third leg. A support arm extends between the spacing arms. A ball sleeve rotatably extends around the support arm. The ball sleeve has a cord extending therefrom. A tether ball is coupled to the cord.

In these respects, the ball therapy device according to the present invention substantially departs from the conventional concepts and designs of the prior art, and in so doing provides an apparatus primarily developed for the purpose of providing a means of exercise for improving strength, range of motion, and coordination.

SUMMARY OF THE INVENTION

In view of the foregoing disadvantages inherent in the known types of therapy devices now present in the prior art, the present invention provides a new ball therapy device construction wherein the same can be utilized for providing a means of exercise for improving strength, range of motion, and coordination.

The general purpose of the present invention, which will be described subsequently in greater detail, is to provide a new ball therapy device apparatus and method which has many of the advantages of the therapy devices mentioned heretofore and many novel features that result in a new ball therapy device which is not anticipated, rendered obvious, suggested, or even implied by any of the prior art therapy devices, either alone or in any combination thereof.

To attain this, the present invention generally comprises a generally U-shaped frame with first and second legs and a cross member extending between upper ends of the legs. A pair of third legs are coupled to the upper ends of the first legs. A pair of spacing arms are provided. One of the spacing arm is slidably coupled to the first leg and the associated third leg. The other of the spacing arms is slidably coupled to the second leg and the associated third leg. A support arm extends between the spacing arms. A ball sleeve rotatably extends around the support arm. The ball sleeve has a cord extending therefrom. A tether ball is coupled to the cord.

An important aspect of the short range or long term rehabilitation planning involves educating a patient to maintain strength, range of motion and coordination, as well as to maintain the optimal state of health and functional skills and level of physical fitness. The present device emphasizes coordinated activities between various parts of the body and muscle groups, which is much more effective than working only individual muscles, as most of the prior art therapy devices do.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ball therapy device apparatus and method which has many of the advantages of the therapy devices mentioned heretofore and many novel features that result in a new ball therapy device which is not anticipated, rendered obvious, suggested, or even implied by any of the prior art therapy devices, either alone or in any combination thereof.

It is another object of the present invention to provide a new ball therapy device which may be easily and efficiently manufactured and marketed.

It is a further object of the present invention to provide a new ball therapy device which is of a durable and reliable construction.

An even further object of the present invention is to provide a new ball therapy device which is susceptible of a low cost of manufacture with regard to both materials and labor, and which accordingly is then susceptible of low prices of sale to the consuming public, thereby making such ball therapy device economically available to the buying public.

Still yet another object of the present invention is to provide a new ball therapy device which provides in the apparatuses and methods of the prior art some of the advantages thereof, while simultaneously overcoming some of the disadvantages normally associated therewith.

Still another object of the present invention is to provide a new ball therapy device for providing a means of exercise for improving strength, range of motion, and coordination.

Yet another object of the present invention is to provide a new ball therapy device which includes a generally U-shaped frame with first and second legs and a cross member extending between upper ends of the legs. A pair of third legs are coupled to the upper ends of the first legs. A pair of spacing arms are provided. One of the spacing arm is slidably coupled to the first leg and the associated third leg. The other of the spacing arms is slidably coupled to the second leg and the associated third leg. A support arm extends between the spacing arms. A ball sleeve rotatably extends around the support arm. The ball sleeve has a cord extending therefrom. A tether ball is coupled to the cord.

Still yet another object of the present invention is to provide a new ball therapy device that permits a user to engage in very low stress physical therapy.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
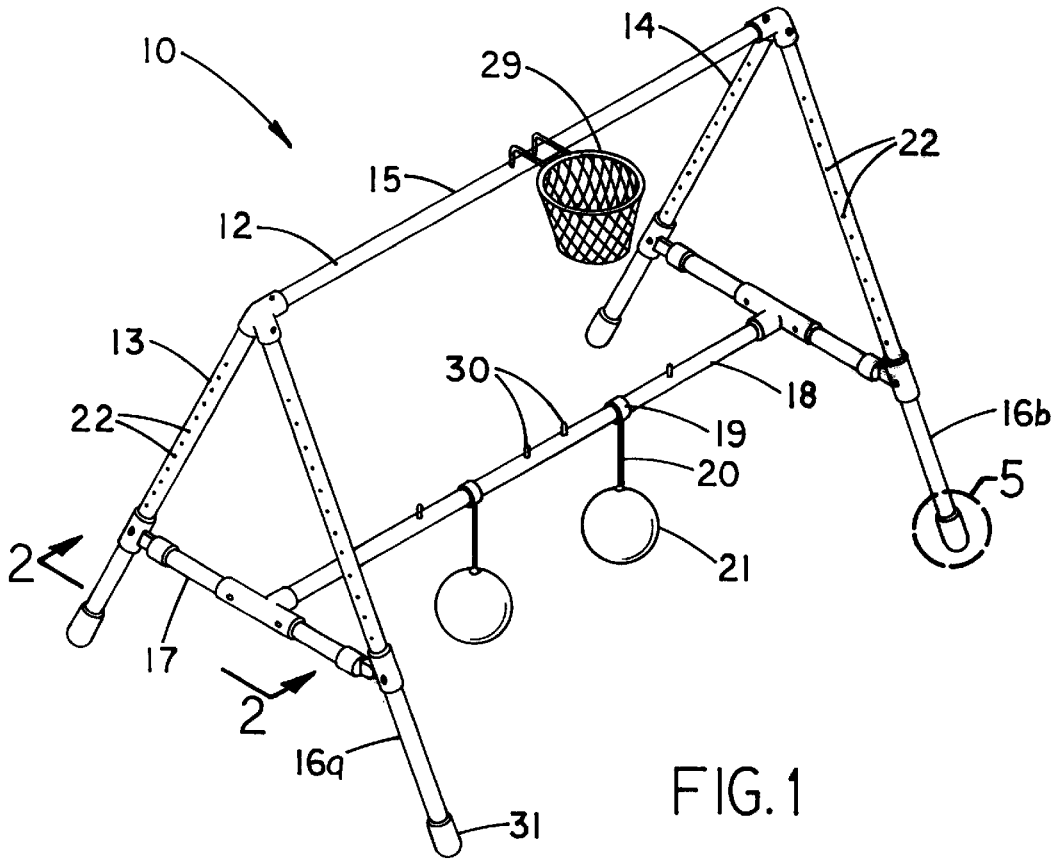
FIG. 1 is a schematic perspective view of a new ball therapy device according to the present invention.
Figure 2:
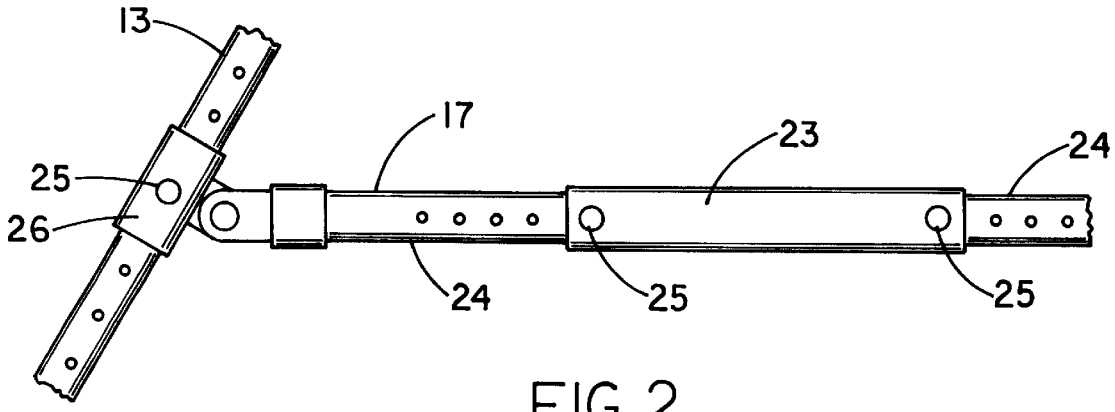
FIG. 2 is a schematic detailed view of the present invention taken from line 2—2 of FIG. 1.
Figure 3:
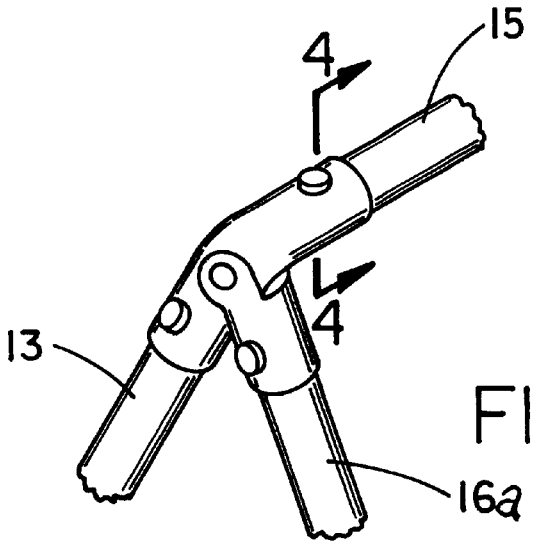
FIG. 3 is a schematic detailed view of the present invention.
Figure 4:
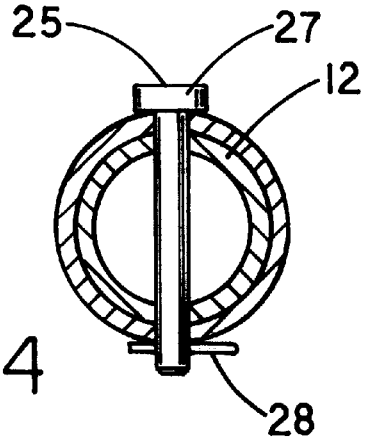
FIG. 4 is a schematic cross sectional view of the present invention taken from line 4—4 of FIG. 3.
Figure 5:
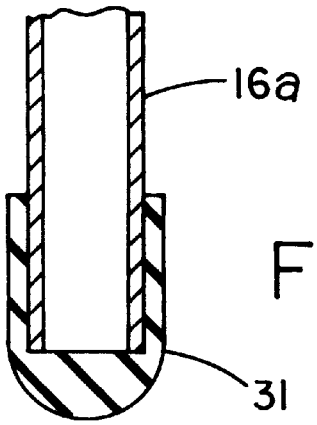
FIG. 5 is a schematic cross sectional view of the present invention taken from circle 5—5 of FIG. 1.

With reference now to the drawings, and in particular to FIGS. 1 through 5 thereof, a new ball therapy device embodying the principles and concepts of the present invention and generally designated by the reference numeral 10 will be described.

As best illustrated in FIGS. 1 through 5, the ball therapy device 10 generally comprises a generally U-shaped frame 12 with first second, third, and fourth legs 13,14 16*a*, 16*b* and a cross member 15 extending between upper ends of the legs. Third and fourth legs 16*a* and 16*b* are coupled to the upper ends of the first second legs. A pair of spacing arms 17 are provided. One of the spacing arm is slidably positionable along the first leg and the associated third leg. The other of the spacing arms is selectively slidably, selectively positionable along the second leg and the associated fourth leg. A support arm 18 extends between the spacing arms. A ball sleeve 19 rotatably extends around the support arm. The ball sleeve has a cord 20 extending therefrom. A tether ball 21 is coupled to the cord.

Protuberances 30 may extend from the support arm to limit movement of the ball sleeves along the support arm.

The balls should be very light so that the impact from hitting the balls is minimal. Ideally, beach balls are used.

Preferably, the third and fourth legs are pivotally coupled to the upper ends of the first and second legs so that the legs may be folded together for storage. See FIG. 3.

Preferably, the spacing arms are slidably positionable along the first, second, and third legs. To permit this, each of the first, second, third, and fourth legs has a row of apertures 22 therealong. Each of the spacing arms has a central portion 23. A pair of telescoping arms 24 are telescopically received in the central portion and held in place by pins 25 extending through openings in the central portion and telescoping arm. A pair of sleeves 26 are pivotally coupled to free ends of the telescoping arm. The sleeves have holes therethrough. A plurality of pins extend through the holes of the sleeves of the support arms and into the apertures of the legs. Each of the pins has a head 27 at one end and a hole through the other. Retaining rods 28 extend through the hole to secure the pins in place.

Optionally, a hoop 29 is detachably coupled to the cross member and dimensioned for receiving the tether balls.

Preferably, each of the first, second, third, and fourth legs has a resiliently deformable cap 31 coupled thereto for frictionally engaging a ground surface. Ideally, each of the caps is made of rubber and has a rounded tip.

The preferred length of the cross member between its ends is about 24 inches. The preferred length of the first, second, and third legs is about 80 inches between their ends so that the support arm can be raised for boxing and lowered for kicking.

In use, the third, and fourth legs arc pivoted away from the first and second legs. The spacing arms are positioned at the desired height and secured in place with the pins. The balls are struck with the arms or kicked. A user may stand, kneel or even lay beneath the balls when striking and kicking them. A wheelchair-bound user may remain in the wheelchair and strike or kick the balls.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A therapy device, comprising:

a generally U-shaped frame having a first leg and a second leg and a cross member extending between upper ends of said legs;

a third leg and a fourth leg pivotally coupled to said upper ends of said first and second legs;

a pair of spacing arms, one of said spacing arms being selectively slidably positionable along said first leg and the associated third leg, the other of said spacing arms being selectively slidably positionable along said second leg and the associated fourth leg;

a support arm extending between said spacing arms;

a ball sleeve rotatably extending around said support arm, said ball sleeve having a cord extending therefrom; and a tether ball being coupled to said cord so that the height of the spacing and support arms is adjustable along the legs.

2. The therapy device of claim 1, wherein each of said first, second, third, and fourth legs has a row of apertures therealong, each of said spacing arms having a central portion, a pair of telescoping arms telescopically received in said central portion, and a pair of sleeves pivotally coupled to free ends of said telescoping arm, said sleeves having holes therethrough, a plurality of pins extending through said holes of said sleeves of said support arms and into said apertures of said legs.

3. The therapy device of claim 1, further comprising a hoop detachably coupled to said cross member and dimensioned for receiving said tether balls.

4. The therapy device of claim 1, wherein each of said first, second, third, and fourth legs have a resiliently deformable cap coupled thereto for frictionally engaging a ground surface.

5. The therapy device of claim 4, wherein each of said caps has a rounded tip.

6. A therapy device, comprising:

a generally U-shaped frame having a first leg and a second leg and a cross member extending between upper ends of said legs;

a third leg and a fourth leg pivotally coupled to said upper ends of said first and second legs;

a pair of spacing arms, one of said spacing arm being selectively slidably positionable along said first leg and the associated third leg, the other of said spacing arms being selectively slidably positionable along said second leg and the associated fourth leg;

a support arm extending between said spacing arms;

a pair of ball sleeves rotatably extending around said support arm, each ball sleeve having a cord extending therefrom;

a pair of tether balls being coupled to said cords;

each of said first, second, third, and fourth legs having a row of apertures therealong, each of said spacing arms having a central portion, a pair of telescoping arms telescopically received in said central portion and a pair of sleeves pivotally coupled to free ends of said telescoping arm, said sleeves having holes therethrough, a plurality of pins extending through said holes of said sleeves of said support arms and into said apertures of said legs; and a hoop detachably coupled to said cross member and dimensioned for receiving said tether balls;

each of said first, second, third, and fourth legs having a resiliently deformable cap coupled thereto for frictionally engaging a ground surface;

each of said caps having a rounded tip.

* * * * *